US009468326B2

(12) United States Patent
Yip et al.

(10) Patent No.: US 9,468,326 B2
(45) Date of Patent: Oct. 18, 2016

(54) COLLAPSIBLE HANGER APPARATUS AND METHODS OF USE THEREOF

(71) Applicant: C & A Business World, LLC, Albany, NY (US)

(72) Inventors: Alice Yip, Albany, NY (US); Ryan DiSanto, Albany, NY (US)

(73) Assignee: C&A BUSINESS WORLD, LLC, Albany, NY (US)

( * ) Notice: Subject to any disclaimer, the term of this patent is extended or adjusted under 35 U.S.C. 154(b) by 0 days.

(21) Appl. No.: 14/338,672

(22) Filed: Jul. 23, 2014

(65) Prior Publication Data

US 2016/0022076 A1 Jan. 28, 2016

(51) Int. Cl.

| | |
|---|---|
| ***A41D 27/22*** | (2006.01) |
| ***A47G 25/40*** | (2006.01) |
| ***A47G 25/50*** | (2006.01) |

(52) U.S. Cl.

CPC ..... *A47G 25/4046* (2013.01); *A47G 25/4061* (2013.01); *A47G 25/50* (2013.01)

(58) Field of Classification Search

CPC ..... A47G 25/40; A47G 25/4015; A47G 25/4023; A47G 25/403; A47G 25/4061; A47G 25/4069; A47G 2025/4092

USPC ..... 223/85, 89, 90, 94, DIG. 4

See application file for complete search history.

(56) References Cited

U.S. PATENT DOCUMENTS

| | | | | |
|---|---|---|---|---|
| 1,682,626 A | * | 8/1928 | Peckham | 223/89 |
| D140,869 S | * | 4/1945 | Powers | D6/319 |
| 2,413,221 A | | 12/1946 | Elston | |
| 2,544,170 A | * | 3/1951 | Mills | 223/89 |
| 2,586,913 A | | 2/1952 | Burns | |
| 3,040,941 A | | 6/1962 | Vargo | |
| 3,703,978 A | | 11/1972 | Sammartino et al. | |
| 4,227,632 A | | 10/1980 | Collis | |

(Continued)

FOREIGN PATENT DOCUMENTS

| | | |
|---|---|---|
| JP | 01151492 | 6/1989 |
| JP | 06181835 | 5/1994 |

(Continued)

OTHER PUBLICATIONS

Collapsible Hangers; www.kokubo-global.com/laundry/color-breeze_laundry-series/3152.html; May 16, 2014. 1 page.

*Primary Examiner* — Nathan Durham

(74) *Attorney, Agent, or Firm* — Schmeiser, Olsen & Watts, LLP

(57) ABSTRACT

A collapsible hanger apparatus and methods using the collapsible hanger apparatus, having both a folded and unfolded configuration, comprising a central body having a suspension member, a first lower extending portion, a second lower extending portion, and a tongue adjacent to the suspension member, the first extending portion and the second extending portion. Said hanger apparatus further comprising a first shoulder pivotally attached to the first lower extending portion of the central body at a first end of the first shoulder, a second shoulder pivotally attached to the second lower extending portion of the central body at a first end of the second shoulder and a crossbar hinge formed by pivotally connecting the first shoulder at a second end to the second shoulder at a second end, wherein the crossbar hinge forms a groove configured to mate with the tongue of the central body.

17 Claims, 5 Drawing Sheets

(56) References Cited

U.S. PATENT DOCUMENTS

| | | | | |
|---|---|---|---|---|
| D330,635 | S * | 11/1992 | Licari | D6/317 |
| 5,383,584 | A | 1/1995 | Adams | |
| 6,062,521 | A * | 5/2000 | Kelley et al. | 248/339 |
| 6,540,121 | B1 | 4/2003 | Harvey | |
| 7,172,102 | B2 | 2/2007 | Lewien et al. | |
| 7,185,795 | B1 | 3/2007 | Wallick | |
| 7,743,954 | B2 | 6/2010 | Chiu | |
| 8,201,685 | B1 * | 6/2012 | Licari | 206/300 |
| 2004/0031825 | A1 * | 2/2004 | Roberts | 223/85 |
| 2014/0138414 | A1 * | 5/2014 | Wasserman et al. | 223/85 |

FOREIGN PATENT DOCUMENTS

| | | |
|---|---|---|
| JP | 2001334099 | 12/2001 |
| JP | 2006158928 | 6/2006 |

* cited by examiner

COLLAPSIBLE HANGER APPARATUS AND METHODS OF USE THEREOF

FIELD OF THE TECHNOLOGY

The following relates generally to an apparatus for hanging clothing and other garments and more specifically, this application relates to a bimodal hanging apparatus that is collapsible and re-extendable as well as methods of use thereof.

BACKGROUND

Conventional clothes hangers typically comprise an integrally formed rigid structure having a hook means or the like for attachment to a hanger rod, a pair of downwardly angled upper members extending in opposite directions from the hook, with or without a lower transverse member extending between the upper members. The shoulders of a garment, such as a shirt, coat or jacket, may often be draped over the upper members of the hanger to suspend the garment from the hanger in a generally upright orientation so as to reduce the risk of wrinkling or creasing garment. When the lower traverse member is present, additional garments, such as pants or trousers may be draped over and/or suspended from the lower transverse member to similarly reduce the risk of wrinkling or creasing of the garment.

Clothing closets in a typical home may often be crowded with hanging items making it difficult to secure to or remove items from a hanger. It may also be difficult identify an open hanger amongst the rest of the hanging garments. Tight necked clothes such as shirts, sweaters and the like are difficult to put on conventional hangers, which tend to stretch and/or deform the tight neck of the garment when placed thereon. Often times, a user of known hangers must utilize both hands to manipulate the garment when adding or removing a garment onto or off of the hanger itself. This can be particularly difficult when the user is holding other garments in their hands or when the clothing is placed in areas that are particularly tight and require the user to physically separate the surrounding garments from the desired hanging space of the selected garment. Therefore, a need exists for a collapsible hanger capable hanging and removing clothing without stretching or deforming the garment and is capable of being operated, using a single hand.

SUMMARY OF THE TECHNOLOGY

A first embodiment of this disclosure relates generally to a collapsible hanger apparatus comprising a central body having a suspension member, a first lower extending portion, a second lower extending portion, and a tongue adjacent to the suspension member, the first extending portion and the second extending portion. The first embodiment, further comprising a first shoulder pivotally attached to the first lower extending portion of the central body at a first end of the first shoulder, a second shoulder pivotally attached to the second lower extending portion of the central body at a first end of the second shoulder and a crossbar hinge formed by pivotally connecting the first shoulder at a second end to the second shoulder at a second end, wherein the crossbar hinge forms a groove configured to mate with the tongue of the central body.

A second embodiment of this disclosure relates generally to a single appendage method for operating a collapsible hanger apparatus comprising the steps of providing a collapsible hanger apparatus in a folded configuration having a tongue attached to a central body, a first shoulder pivotally attached to the central body, a second shoulder pivotally attached to the central body and a crossbar hinge operably linking the first shoulder and the second shoulder together, applying a first force to the crossbar hinge of the collapsible hanger apparatus with a single appendage of a user of the collapsible hanger apparatus and positioning the crossbar hinge toward the direction opposite of the tongue using said first force, until the collapsible hanger apparatus enters an unfolded configuration.

A third embodiment of this disclosure relates generally to a collapsible hanger apparatus having a folded configuration and an unfolded configuration comprising a central body having a suspension member, a first hinge pivotally attached to the central body and a first end of a first arm, a second hinge pivotally attached to the central body and a first end of a second arm, a crossbar hinge pivotally attached to a second end of the first arm and a second end of the second arm, wherein said crossbar hinge having a default position in the folded configuration and a default position in the unfolded configuration and a transformational point located at a position between the crossbar hinge's default position in the folded configuration and the crossbar hinge's default position in the unfolded configuration, wherein said transformational point is located at a position that that is less than 95% of a total distance between the crossbar hinge's default position in the folded configuration and the crossbar hinge's default position in the unfolded configuration.

BRIEF DESCRIPTION OF THE DRAWINGS

Some of the embodiments will be described in detail, with reference to the following figures, wherein like designations denote like members, wherein.

DETAILED DESCRIPTION OF THE DISCLOSURE

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
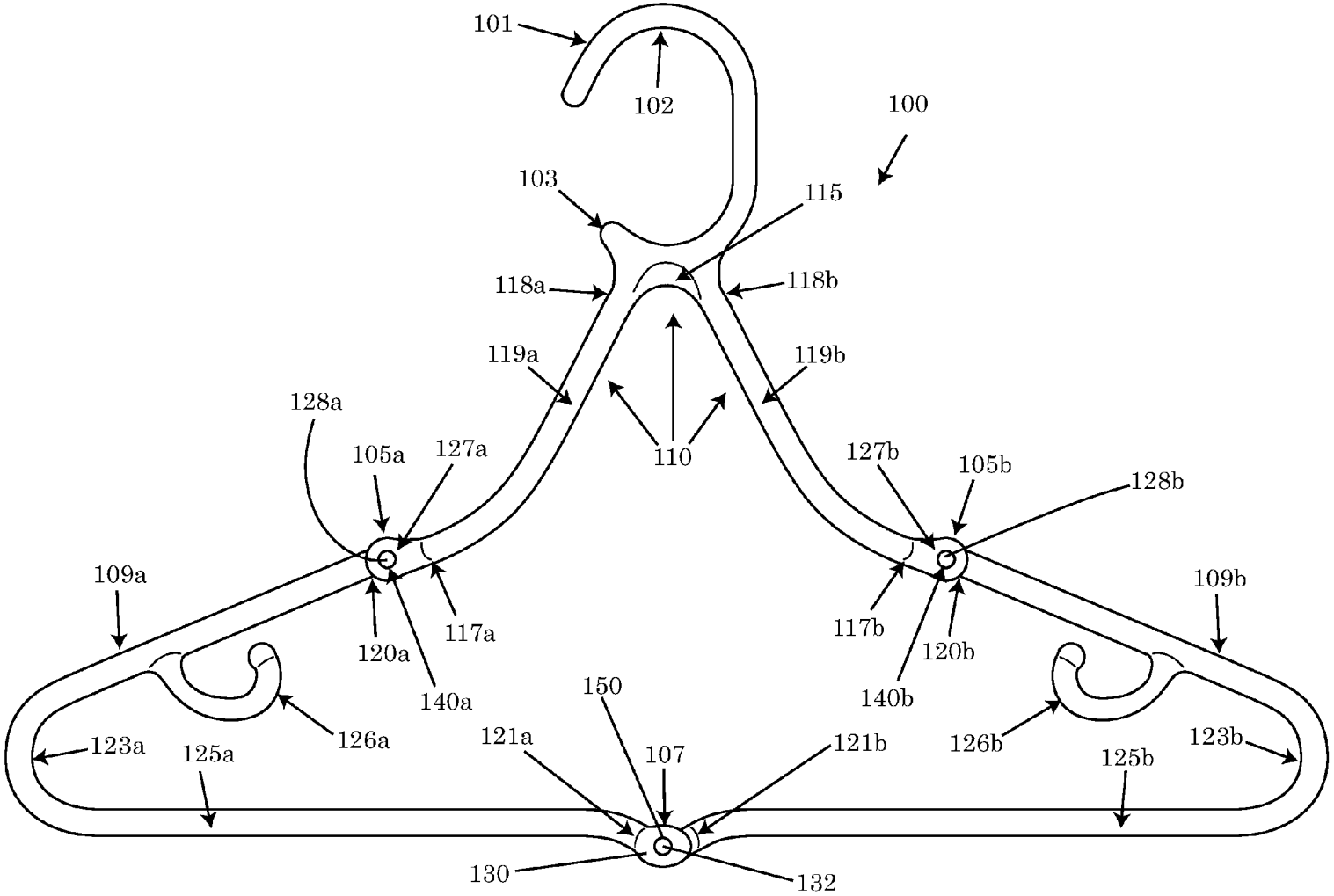
FIG. 1 depicts an embodiment of a collapsible hanger apparatus in an unfolded configuration.

Referring to the drawings, FIG. 1 depicts an embodiment of a collapsible hanger apparatus 100 in an unfolded configuration. The collapsible hanger 100 may be constructed out of any solid or rigid material capable of maintaining its desired configuration. Examples of acceptable materials for constructing the collapsible hanger 100 may include any type of thermoplastic polymers and resins, including but not limited, to poly(methyl methacrylate) (hereinafter "acrylic"), polyamide (nylon), polybenzimidazole, polyethylene (high or low density), polypropylene, polystyrene, polyvinyl chloride, acrylonitrile butadiene styrene, polytetrafluoroethylene, poly trimethylene terephthalate, polyethylene terephthalate, and polybutylene terephthalate. Other materials for constructing the collapsible hanger apparatus may include metal, wood or other known types of plastics that are not specifically listed above.

Embodiments of the collapsible hanger 100 may be configured into three or more distinct sections attached together in a manner that allows for the connection between each portion of the collapsible hanger to rotate or pivot around each other. In the exemplary embodiment, the collapsible hanger may be comprised of three distinct sections, a central body 110, a first shoulder 109*a* and a second shoulder 109*b*. The three distinct sections 110, 109*a*, 109*b* may be interconnected at three distinct rotationally engaged or pivotally engaged hinges 105*a*, 105*b*, 107. Hereinafter, the term "rotate", "pivot" or a variation of these words, when referring to the movement of the hinges or connections between the three distinct sections 110, 109*a*, 109*b* in relation to each other, may be considered synonyms.

The first portion of an embodiment of the collapsible hanger 100 may be referred to as the central body 110. Embodiments of the central body 110 may include a suspension member 101. The suspension member 101 may suspend or hang the collapsible hanger 100 from any surface capable of supporting a standard clothing hanger. For example, the suspension member 101 may engage and suspend the collapsible clothing hanger from a support such as a clothing rod, support bar, closet rod, coat stand, clothing hook, tree limbs or other protrusions, rods, wires, cables and supports capable of engaging with the suspension member 101. The suspension member may be any shape or size, as long as it may be capable of engaging the interior edge 102 of the suspension member along the exterior surface of the support that the collapsible hanger 100 is attempting to be suspended from. In the exemplary embodiment, the suspension member 101 may be a hook shape or may be curved into the shape of the letter "C". In alternative embodiments, the suspension member may be openable, closable or retractable O-shape.

In some embodiments, the central body 110 may further include a retention member 103. The retention member 103 may be integrated with or act as an extension of suspension member 101 in some embodiments. For example, in the embodiment depicted in FIG. 1, the retention member 103 may be a continuation of the suspension member 101 and in some embodiments; the interior edge 102 of the retention member may share and extend the interior edge 102 of the suspension member 101. In other embodiments, the retention member 103 may be independent from or adjacent to the suspension member 101. In such an embodiment, the retention member may function without being a direct continuation of the suspension member 101 or the interior edge 102 of the suspension member 101.

The retention member 103 may functionally assist the suspension member 101 to stabilize and prevent inadvertent removal of the collapsible hanger 100 from the support structure that the suspension member 101 has engaged. For example, in an embodiment wherein a suspension member 101 has engaged a support such as a clothing rod, and the embodiment of the collapsible hanger 101 lacks a retention member 103, the collapsible hanger may be inadvertently removed if the collapsible hanger 100 is inadvertently raised upward by a force, such as a user bumping the collapsible hanger 100. The force of a user bumping into the collapsible hanger 100 may cause the hanger to rise upward and become disconnected from the clothing rod or other support. Conversely, in an embodiment wherein the retention member 103 may be present, when a force raises the suspension member 101 upward, inadvertently disconnecting the suspension member 101 from the support the collapsible hanger 100 is suspended from, the retention member 103 may re-engage the exterior surface of the support. This re-engagement between the retention member 103 may prevent the collapsible hanger 100 from becoming disconnected completely from the support. Instead, the retention member 103 may engage the support until the force displacing the suspension member 101 from the support ceases. Once the force displacing the suspension member 101 from the support has ceased, a force, such as the force of gravity may allow the suspension member 101 to re-engage the support at a point of contact between the suspension member 101 and the exterior surface of the support structure.

Embodiments of the central body 110 may further include a first lower extending portion 119*a* and a second lower extending portion 119*b*. The first and second lower extending portions 119 of the central body 110 may be elongated members or arm like projections that may extend from, and/or may be adjacent to, the suspension member 101 and/or the retention member 103. The first and second lower extending portions 119 of the central body may vary in length as well as shape. The size and shape of the collapsible hanger 100, may vary depending on the support structure being engaged, the size of the garments being suspended from said support and the weight of the garments. For example, in some embodiments, the first or second lower extending portions 119 may be less than 12 inches in length, less than 10 inches, less than 7 inches, less than 4 inches or less than 2 inches in length. In other embodiments, the first or second lower extending portions 119 may be greater than 12 inches in length.

Embodiments of the lower extending portion 119 may be straightened or curved at various positions and angles along the length of the first and/or second lower extending portions. For example, in the exemplary embodiment, the lower extending portions 119 may extend from the first end 118*a*, 118*b* to a distal end 117*a*, 117*b* of the lower extending portions 119 in a manner that may resemble a concave upward direction. In alternative embodiments, the lower extending portions 119 of the central body 110 may extend in a straight line from the first end 118*a*, 118*b* to the distal end 117*a*, 117*b*. Whereas in other alternative embodiments, the shape of the lower extending portions 119, may be resemble other convex shapes including extending in a concave downward fashion.

Figure 4:
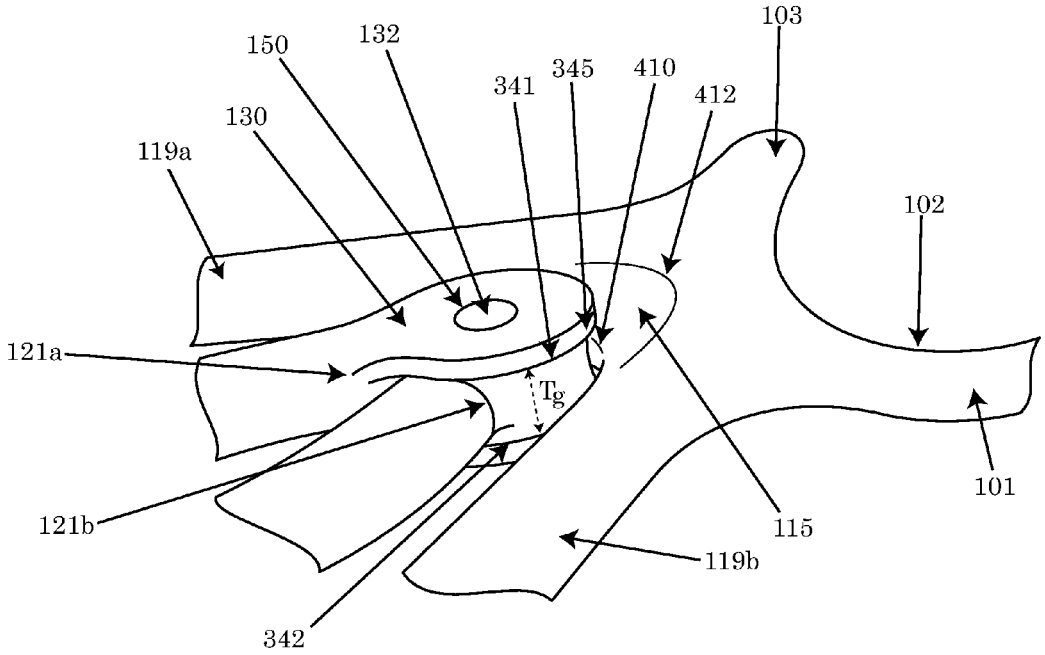
FIG. 4 depicts an embodiment of a crossbar hinge of the collapsible hanger apparatus in a folded configuration.

Embodiments of the central body 110 of the collapsible hanger 100, may further include a tongue 115. The tongue 115 in some embodiments may be placed in a position adjacent to the first and second lower extending portions 119*a*, 119*b*. The tongue 115 may also be located adjacent to suspension member 101 and/or the retention member 103. FIG. 4's depiction of an embodiment of the tongue 115, provides a clear view as to the shape the tongue 115 may resemble. As shown in the exemplary embodiment, the tongue 115 may have a varying width that tapers in thickness between the first edge 412 of the tongue 115 and the second edge 410 of the tongue 115. In some embodiments, the thickness of the tongue at the thickest point may be measured between the first edge 412 on the first side of the tongue, and the first edge on the reverse side of the tongue 115. The measurement between the first edge 412 and the first edge on the reverse side of the tongue 115, may be described as having a thickness $T^1$. In some embodiments, the thickness $T^1$ of the tongue 115 may be uniform and equal to the thickness of the remaining portions of the central body 110, including the lower extension portions 119, the suspension member 101 or the retention member 103. In an alternative embodiment, the thickness of the tongue $T^1$ at the first edge 412 and the first edge on the reverse side, may be less than the thickness of at least one section of the central body 110.

At the opposite end of the tongue 115, a second thickness ($T^2$—not picture) may be measured. The second thickness $T^2$, may be measured between the second edge 410 and the second edge of the tongue 115 located on the reverse side of the tongue 115. In some embodiments, the thickness of $T^1$ may be greater than, or equal to the thickness of the tongue $T^2$. In alternative embodiments of the tongue 115, the thickness of the tongue 115 starting at $T^1$ may gradually decrease in thickness as the section of tongue 115 being measured becomes further in distance from the first edge 412. Conversely, in some embodiments, the thickness of the tongue 115 may be greater than the thickness $T^2$ at any measurement of the tongue's thickness, for any section, between $T^2$ and $T^1$. Moreover, in some embodiments, the thickness of any given cross section of the tongue may gradually increase in thickness as the distance between the section being measured for thickness becomes further in distance from the second edge 410. Accordingly, in some embodiments, the tongue 115 of the central body may have a thickness at a first section T1 that may be greater than the thickness of the tongue 115 measure at a second or subsequent section of the tongue 115.

In some embodiments, the central body 110 of the collapsible hanger 100 may be pivotally attached to a first shoulder 109*a* and a second shoulder 109*b* via a first hinge 105*a* and a second hinge 105*b* respectively. The hinges 105, may be any form of connection that allows the shoulder 109 to move rotationally around a fixed point in relation to the lower extension 119, or the central body 110. For example, the hinge 105 may include butt hinges, t-hinges, strap hinges, gate hinges, double action hinges, pivot hinge or piano hinge. Other rotational and pivoting connections may include pinned connections and universal joints (U-Joint, Cardan Joint, Hardy-Spicer Joint or Hooke Joint).

In one embodiment, the pivotal attachment forming the hinges 105*a*, 105*b*, between the central body 110 and the shoulders 109*a*, 109*b*, may be the result of a connection made between the distal end 117 of the lower extension 119 and a first end 120 of the shoulder 109. For example, in some embodiments, the distal end 117 of the lower extensions 119 may be configured with a female receptacle 127*a*, 127*b* capable of receiving and mating with a male connector 128*a*, 128*b* affixed to the first end 120 of the shoulder 109. In an alternative embodiment, the male connector 128 and the female receptacle 127 may reverse positions and locations on the distal end 117 of the lower extension 119 and the first end of the shoulder 109. For example, in an alternative embodiment, the distal end 117 may be equipped with the male connector 128 and the first end 120 of the shoulder 109 may be equipped with the female receptacle 127.

In the exemplary embodiment, the female receptacle 127 may include a U-shaped groove or gap 330 capable of receiving the male connector 128 that may be defined by a first wall 331 and a second wall 332 extending from the distal end 117 of the lower extension member 119, and placed on either side of the U-shaped groove or gap 330. In addition, embodiments of the female receptacle 127 may further include one or more ports or holes 140 along the first wall 331 and/or a matching set of ports or holes present on the second wall 332. The male connector 128, capable of making a fitted connection with the female receptacle 127, may extend from the first end of the shoulder 120. In some embodiments, the male connector 128 may be sized to fit between the U-shaped groove or gap 330 of the female receptacle 127. Once positioned between the gap or groove 330, the male connector 128 may mate with the female receptacle 127 in a manner capable of allowing the shoulder 109 to pivotally rotate in any desired direction. In the exemplary embodiment, the male connector 128 at the first end of the shoulder 120 may further include one or more protrusions that may be fitted or snap fitted into one or more of the ports or holes 140 of the female connector 127. Once mated with the female receptacle 127, the male connector 128 may be able to rotate centripetally about the female receptacle 127, around an axis formed by the one or more protrusions mating with the port 140. Accordingly, the rotational movement afforded the male connector 128 may be extended to components adjacent or connected in line with the male connector, including each component of the shoulder 109 described herein.

In some embodiments, a user may desire to limit the rotational freedom of the male connector 128 that has been pivotally mated with the female receptacle 127. In some embodiments, the degrees of rotation of the male connector 128 may have, in relation to the female receptacle 127 may be adjusted depending on the position of the distal end 117 of the lower extending member 119 and the length of the female connector 127 attached thereto. For example, as the amount distance between the distal end 117 of the lower extending member 119 and the port 140 increases, the amount of degrees of rotation provided to the male connector 128 may increase, up to the maximum degrees of rotation of approximately 360°. Conversely, as the length of the female connector decreases, or the distance between the port 140 and the distal end 117 of the lower extending member 119 decreases, the rotational freedom of the male connector 128 may also decrease. In alternative embodiments, one or more mechanisms such as pins, cotter keys, molded stoppers may be added to the hinge to limit the rotation of hinge 105. In the Exemplary embodiment, the natural shape of the collapsible hanger 100 may be used to limit the rotational freedom of the hinge to less than 360°, less than 270°, less than 180°, less than 90°, or less than 45°.

Embodiments of the collapsible hanger apparatus 100 may further include a first shoulder 109*a* and a second shoulder 109*b*. Each of the shoulders 109 may include a first end 120 and a second end 121. Embodiments of the shoulders 109 may include a portion of, or all of, the components that may be needed to form a pivoting or rotating hinged connection 105 with the lower extension 119 and the opposite shoulder 109. As described in greater detail above, each of the shoulders 109 may include a mating connection, at the first end 120 of the shoulder 109 to pivotally attach the first shoulder 109*a* and second shoulder 109*b* to the respective first lower extension 119*a* and the second lower extension 119*b*. For example, to form the pivoting or rotating connection of the first hinge 105*a*, the first end 120*a* of the first shoulder 109*a* may be equipped with a male connector 128*a* or female receptacle 127*a*. Whether the connector/receptacle at the first end 120*a* is male or female, may depend on which connector or receptacle is present at the distal end 117*a* of the first lower extension member 119*a*. Accordingly, in embodiments having a female receptacle 127*a* present at the distal end 117*a* of the first lower extension member 119*a*, then the first end 120*a* of the first shoulder 109*a* may be equipped with a male connector 128*a*, capable of mating with the female receptacle 127*a* and vice versa if the embodiment includes a distal end 117*a* that is equipped with a male connector 128.

Embodiments pivotally connecting the second shoulder 109*b* and the second lower extending portion 119*b* may mirror the connection between first shoulder 109*a* and the first lower extending portion 119*a*, in some embodiments. In Alternative embodiments, the positions of the male/female connection forming the second hinge 105*b* made may be the inverse relationship of the first hinge 105*a*. An example of an embodiment having an inverse relationship of connections between the first hinge 105*a* and the second hinge 105*b* may be present if the connection forming the first hinge 105*a* includes a female receptacle 127*a* at the distal end 117*a* of the first lower extension portion 119*a*, and a male connector 128*a* on the first end 120*a* of the first shoulder 109*a* and the first end of the second lower extension 119*b* is equipped with a male connector 128*b* while the mating connection on the second shoulder 120*b* is a female receptacle 127*b*.

In some embodiments, the first shoulder 109*a* and second 109*b*, may each be formed by an arm 125*a*, 125*b* extending between the first end 120 and the second end 121 of each shoulder 109. The arm 125 portion of the shoulder 109 may be various lengths, shapes and orientations. For example, the arm may extend at an angle between 0-90° at the section of the arm extending between the first end 120 of the shoulder 109 and the start of the bend 123 of the shoulder 109. The positioning of the arm 125 between the first end 120 and the bend 123 may be a straight line or in some embodiments, the curvature of the arm may vary, including various convex orientations such as concave up or concave downward positions. After the bend 123 is made in the arm 125, the arm 125 may continue to extend from the bend 123 to the second end 121 of the shoulder 109 at an angle of approximately 180°.

In some embodiments, the arms 125 of each of the shoulders 109*a*, 109*b* may include at least one or more accessory hooks 126*a*, 126*b*. Embodiments of the accessory hook may curved in any manner known for holding additional garments or accessories such as pants, scarves watches, necklaces, jewelry or any other piece of fashionware typically hung on an accessory hook 126*a*, 126*b*.

In some embodiments, the arm 125 of the shoulder 109 may taper at a downward angle for at least one portion the first shoulder 109*a* or second shoulder 109*b*, before reaching the second end 121 of the shoulder 109, adjacent to the crossbar hinge 107. The angle of the tapering may be an obtuse angle. In some embodiments, the angle of the tapering at the second end 121 of the shoulder 109 may be measured as an angle greater than 180°.

Embodiments of the collapsible hanger apparatus 100 may further include a crossbar hinge 107. Referring back to the drawings, FIGS. 1-4 disclose embodiments of a crossbar hinge 107. In some embodiments, the crossbar hinge may be a formed as a connection between the second end 121*a* of the first shoulder 109*a* and the second end 121*b* of the second shoulder 109*b*. The connection linking the first 109*a* and second 109 shoulders together may be formed or function in a manner similar to the first hinge 105*a* and the second hinge 105*b* in some embodiments. For example, the connections forming the crossbar hinge 107 may function in a manner that may allow the arms 125 of the first shoulder 109*a* and the second shoulder 109*b* to rotate or pivot in relation to one another. Embodiments of the crossbar hinge 107 may be formed by mating connector 132 with receptacle 130, using any method described above for the first hinge 105*a* and the second hinge 105*b*. For example, embodiments of the crossbar hinge may be formed into pivoting connections including hinges such as butt hinges, t-hinges, strap hinges, gate hinges, double action hinges, pivot hinge, piano hinge, or other rotational and pivoting connections such as pinned connections and universal joints (U-Joint, Cardan Joint, Hardy-Spicer Joint or Hooke Joint). Embodiments of the crossbar hinge 107, as well as hinges 105*a*, 105*b*, may include connections that may be formed without the inclusion of any spring elements.

In one embodiment, the pivotal attachment forming the crossbar hinge 107 between the first shoulder 109*a* and the second shoulder 109*b*, may be the result of a connection made between the second end 121*a* of the first shoulder 109*a* and the second end 121*b* of the second shoulder 109*b*. For example, in some embodiments, the second end 121*a* of the first shoulder 109*a* may be configured with a female receptacle 130 capable of receiving and mating with a male connector 132 affixed to the second end 121*b* of the second shoulder 109*b*. The female receptacle 130 may be configured to receive a male connector 132 inserted therein. In an alternative embodiment, the male connector 132 and the female receptacle 130 may reverse positions and locations. For example, in an alternative embodiment, the second end 121*a* of the first shoulder 109*a* may be equipped with the male connector 132 and the second end 121*b* of the second shoulder 109*b* may be equipped with the female receptacle 130.

Embodiments of the crossbar hinge 107 may be constructed into any desired shape. For example, in some embodiments, the crossbar hinge may be a round or a circular shape. Alternatively, in the exemplary embodiment, the crossbar hinge 107 may be ovular or egg-shaped. The crossbar hinge 107, may be ovular or egg-shaped in some embodiments, to further accommodate a greater range of rotational or pivoting motion by the arms 125 of the shoulders 109 in relation to each other as the hinge is adjusted from a first position to a second position or there is a change in the configuration, for example a folded configuration 200 to an unfolded configuration 100.

In the exemplary embodiment, the female receptacle 130 may include a groove or gap, capable of receiving the male connector 132. In some embodiments, this groove or gap may be described as being U-shaped. The U-shaped groove or gap may be defined by a first wall 341 and a second wall 342 of the female receptacle 130, and may have a hollow space between said first wall 341 and second wall 342. In addition, embodiments of the female receptacle 130 may further include one or more ports or holes 150 that may bore through the first wall 341 of the female receptacle 130 and/or a matching set of ports or holes boring through the second wall 342.

The male connector 132, capable of being inserted into the female receptical, making a fitted connection with the female receptacle 130, may extend from the second end 121 of the shoulder 109. In some embodiments, the male connector 132 may be sized to fit between the U-shaped groove or gap of the female receptacle 130. Once positioned between the gap or groove, the male connector 132 may mate with the female receptacle 130 in a manner capable of allowing both the first shoulder 109*a* and the second shoulder 109*b* to pivotally rotate in relation to one another.

In the exemplary embodiment of the crossbar hinge 107, the male connector 132 at the second end of the shoulder 109 may further include one or more protrusions that may be fitted or snap fitted into one or more of the ports or holes 150 of the female connector 130. Once mated with the female receptacle 130, the male connector 132 may be able to rotate centripetally about the female receptacle 130, for example, around an axis formed by the one or more protrusions mating with the port 140. Accordingly, the rotational movement afforded the male connector 132 may be extended to components adjacent or connected in line with the male connector, including the shoulder 109, and the arms 125 comprising the shoulder.

The gap or groove of the female receptacle 130 formed between the first wall 341 and second wall 342 may have a groove or gap thickness $T_g$ measured as the distance between the interior walls of the first wall 341 and the second wall 342. In some embodiments, the groove or gap thickness $T_g$ may be measured to have a distance or thickness greater than or equal to the thickness of the tongue 115 at the second edge 410. In alternative embodiments, the thickness of the groove or gap $T_g$ may be measured as a distance greater than or equal to the thickness of the tongue 115, at the $1^{st}$ edge 412, depicted by the thickness $T_1$.

Figure 2:
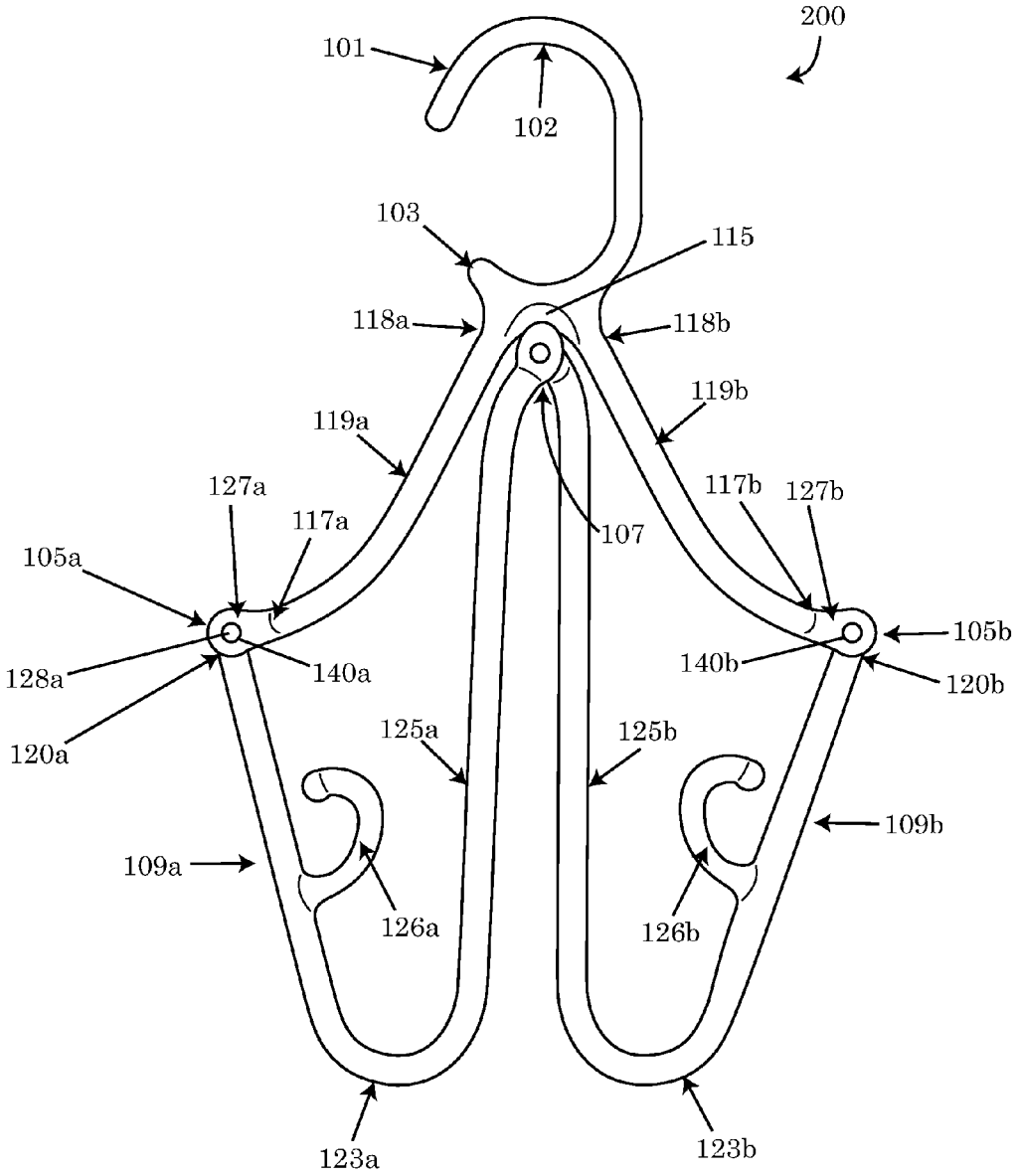
FIG. 2 depicts the collapsible hanger apparatus of FIG. 1 in a folded configuration.

Embodiments of the collapsible hanger may be adjusted or folded into multiple configurations. FIG. 1 and FIG. 2 demonstrate embodiments of the collapsible hanger in an unfolded configuration 100 and a folded configuration 200. In some embodiments, the collapsible hanger may be adjusted from an unfolded configuration 100 to a folded configuration 200 as well as from a folded configuration 200 to an unfolded configuration. Embodiments of the crossbar hinge described above as having a groove or gap with a thickness $T_g$, may be configured to use the groove or gap as a slot for mating with the tongue 115 of the central body 110 and nestling the tongue 115 into the groove or gap. For example, as the collapsible hanger is placed into the folded configuration 200, the crossbar hinge may be adjusted, manipulated or moved toward the direction of the tongue 115. As the tongue 115 becomes adjacent to the groove or gap, the second edge 410 of the tongue may enter the groove between the first wall 341 and the second wall 342. The distance the tongue 115 may enter the groove or gap may depend on the depth of the groove or gap. In some embodiments, only a portion of the tongue 115 may be mated with the groove or gap. In alternative embodiments, the groove or gap may be large enough to receive the tongue from second edge 410 and mate with the tongue, extending up to and/or including the first edge 412.

Figure 3A:
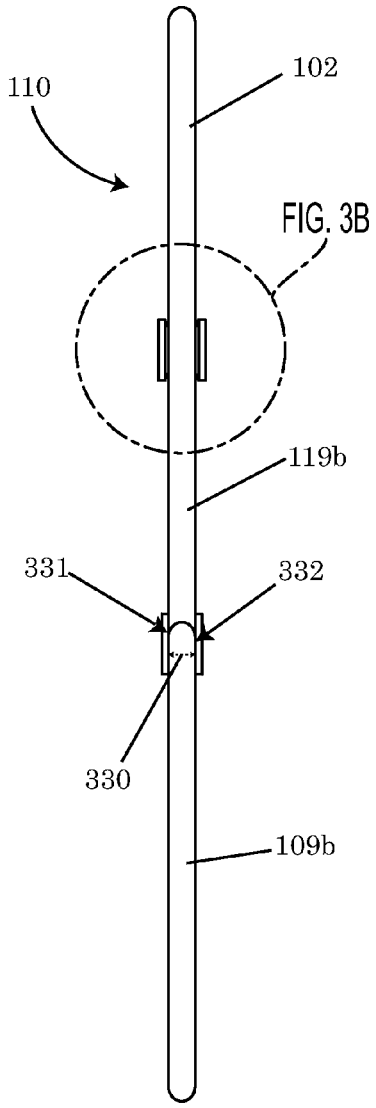
FIG. 3A depicts an embodiment of a side view of the collapsible hanger apparatus of FIG. 2.
Figure 3B:
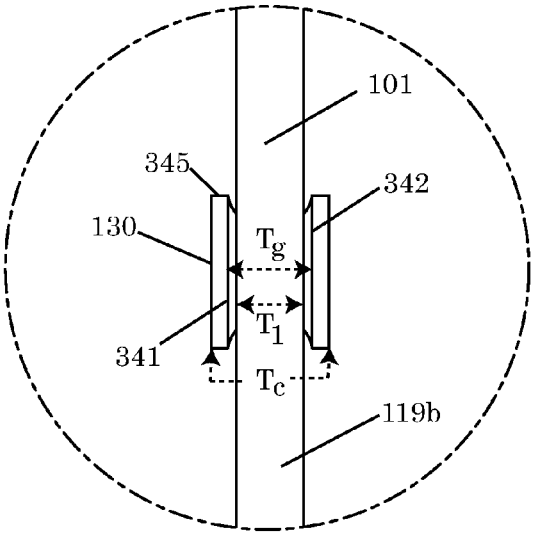
FIG. 3B depicts a close-up view of a selected portion of the collapsible hanger apparatus depicted in FIG. 3A.

Embodiments of the crossbar hinge may also vary in thickness. The thickness of the crossbar hinge in embodiments having a female receptacle 130 coupled with a male connector 132 may be measure as the distance between the outer edge of each female receptacle wall. As depicted in the embodiment of FIG. 3, this thickness of the crossbar 107 is depicted as the thickness $T_c$. In some embodiments, the thickness $T_c$ may be greater than or equal to the thickness of one or more of the component parts that make up the rest of the collapsible hanger, such as the arms 125 and the bends 123 that make up the shoulder 109, the central body 110 including lower extension portions 119, the tongue 115, the suspension member 101 or the retention member 103. In embodiments wherein the thickness $T_c$ of the crossbar hinge 107 is greater than or equal to the thickness of the tongue 115, suspension member 102 or the lower extension member 119 of the central body, the portions of the crossbar hinge 107 extending beyond the width of the central body's components may act in a manner to guide the user or provide an area for a user to adjust or manipulate the crossbar hinge without interfering with the components of the central body 110.

In some embodiments, the mechanism for making an adjustment between the unfolded 100 and folded configurations 200 may be achieved by rotating or pivoting the first shoulder 109*a* and the second shoulder 109*b* at the first hinge 105*a* and second hinge 105*b* respectively as well as pivoting or rotating the first and second shoulders at the second end of the shoulder 121*a*, 121*b* affixed to the crossbar hinge 107. In some embodiments, the crossbar hinge 107, first hinge 105*a* and the second hinge 105 may effectively be linked together and act in concert with each other to achieve the folded 200 and unfolded configuration 100. Each hinge 107, 105*a*, 105*b*, may effectively rotate or pivot as needed in response to the rotation or pivot made by the other hinges. In one embodiment, a user may manipulate the confirmation from the unfolded configuration 100 to the folded configuration by adjusting the position of the crossbar hinge 107. In such an embodiment, the user may begin moving the crossbar hinge from the default position depicted in FIG. 1, toward the tongue 115. As the crossbar hinge 107 is being raised toward the tongue 115, one or more components of the collapsible hanger 100 may be moving, adjusting or rotating simultaneously to compensate for the adjustment to the crossbar hinge's position.

For example, as the crossbar hinge is raised, toward the tongue 115, arms 125*a*, 125*b* of the first 109*a* and second 109*b* shoulder, may rotate or pivot inward to the positions demonstrated in FIG. 2, toward the direction of the crossbar hinge's default position depicted in FIG. 1. Simultaneously, as the crossbar hinge is being moved in the direction toward the tongue 115, the arms 125 of the shoulder 109, between the bend 123 and the second end 121 of the shoulder 109, may gradually adjust from an angle of approximately 180° at the initiation of the movement of the crossbar hinge 107, to approximately an angle of 90° as the crossbar hinge 107 approaches closer to the tongue 115. Moreover, in some embodiments, as the crossbar hinge 107 is moving in a direction toward the tongue 115, the arm 125*a* of the first shoulder 109*a* at the first end 120*a* may rotate about the first hinge 105*a* in a counterclockwise fashion. Accordingly, the opposite side comprised of shoulder 109*b* may adjust as well. As the tongue crossbar hinge moves in a direction toward the tongue 115, the arm 125*b* of the shoulder 109*b* connected at the first end 120*b*, may rotate clockwise around the hinge 105. In such an embodiment, the shoulders 109*a* and 109*b* may continue to rotate until a condition is met that prohibits further rotation on at least one of the hinges such as the crossbar hinge 107 reaches its default position depicted in FIG. 2, the arm 125*b* can no longer rotate or pivot on hinge 105*b* or the arm 125*a* can longer rotate or pivot about hinge 125*a*.

Conversely, the collapsible hanger in the folded configuration 200 may also be adjusted into the unfolded confirmation, by adjusting the position of any of the components rotationally connected to the first hinge 105*a*, the second hinge 105*b* or the crossbar hinge 107. For example, similar to the method described above for folding the collapsible hanger 100 into the folded configuration, the folded hanger 200 may be placed into the unfolded configuration in one embodiment by adjusting the position of the crossbar hinge 107. As depicted in the embodiment in FIG. 2, the crossbar hinge's default position in the folded configuration may be adjacent to, in contact with and/or encompassing at least a portion of the tongue 115. As the crossbar hinge 107 is adjusted toward the default position of the crossbar hinge depicted in FIG. 1, the arms 125 of the shoulder 109 may pivot or rotate in the opposite direction than they had when they positioned themselves into the folded conformation. In some embodiments, the arms 125 of the shoulders 109 between the bend 123 and the second position 125 may adjust from an angle of approximately 90° to an angle of approximately 180°. Moreover, in some embodiments, as the crossbar hinge 107 moving in a direction away from the tongue 115, the arm 125*a* of the first shoulder 109*a* at the first end 120 may rotate about the first hinge 105*a* in a clockwise fashion. Accordingly, the opposite side comprised of shoulder 109*b* may adjust as well. As the tongue crossbar hinge moves in a direction away from the tongue 115, the arm 125*b* of the shoulder 109*b* connected at the first end 120*b*, may rotate counterclockwise. In such an embodiment, the shoulders 109*a* and 109*b* may continue to rotate until the crossbar hinge 107 reaches its default position depicted in FIG. 1, the arm 125*b* can no longer rotate on hinge 105*b* or the arm 125*a* can longer rotate or pivot about hinge 125*a*.

In some embodiments, the collapsible hanger may be configured to be bimodally constructed. Embodiments that may have a bimodal construction may switch between the folded and unfolded configuration 100, 200, at least in part without interference or manipulation by a user. For example, in some embodiments, the configuration may be switched from a folded configuration 200 to an unfolded configuration 100 by manipulating the crossbar hinge 107 in a direction opposite of the tongue 115. In an embodiment that has a bimodal configuration, the user may initiate the movement of the crossbar hinge to a particular point between the default position of the crossbar hinge 107 in the folded configuration 200 and the default position of the crossbar hinge 107 in the unfolded configuration 100. Upon reaching or surpassing the particular point, hereinafter the "transformation point", the collapsible hanger may automatically continue to fold or unfold without further manipulation by the user. In some embodiments, the transformation point may be at the midway point between default position of the crossbar hinge 107 in folded confirmation 200 and the default position of the crossbar hinge in the unfolded confirmation 100. In other embodiments, the transformation point may be less than 50% of the distance between the folded default position and the unfolded default positions. In alternative embodiments, the transformation point may be less than 95%, less than 90%, less than 85%, less than 75%, less than 60%, less than 40%, less than 30%, less than 20% or less than 10% of the total distance between the folded default position and the unfolded default positions. In some embodiments, there may be more than one transformational point.

In an alternative embodiment wherein the collapsible hanger is not bimodal, there may not be a transformation point wherein the user may no longer be required to manipulate the crossbar hinge to change configurations of the collapsible hanger. In an embodiment that is not bimodal, the user may be required to guide the crossbar hinge or other components from their default position in the folded or unfolded configuration to the default position in the opposite configuration.

Figure 5:
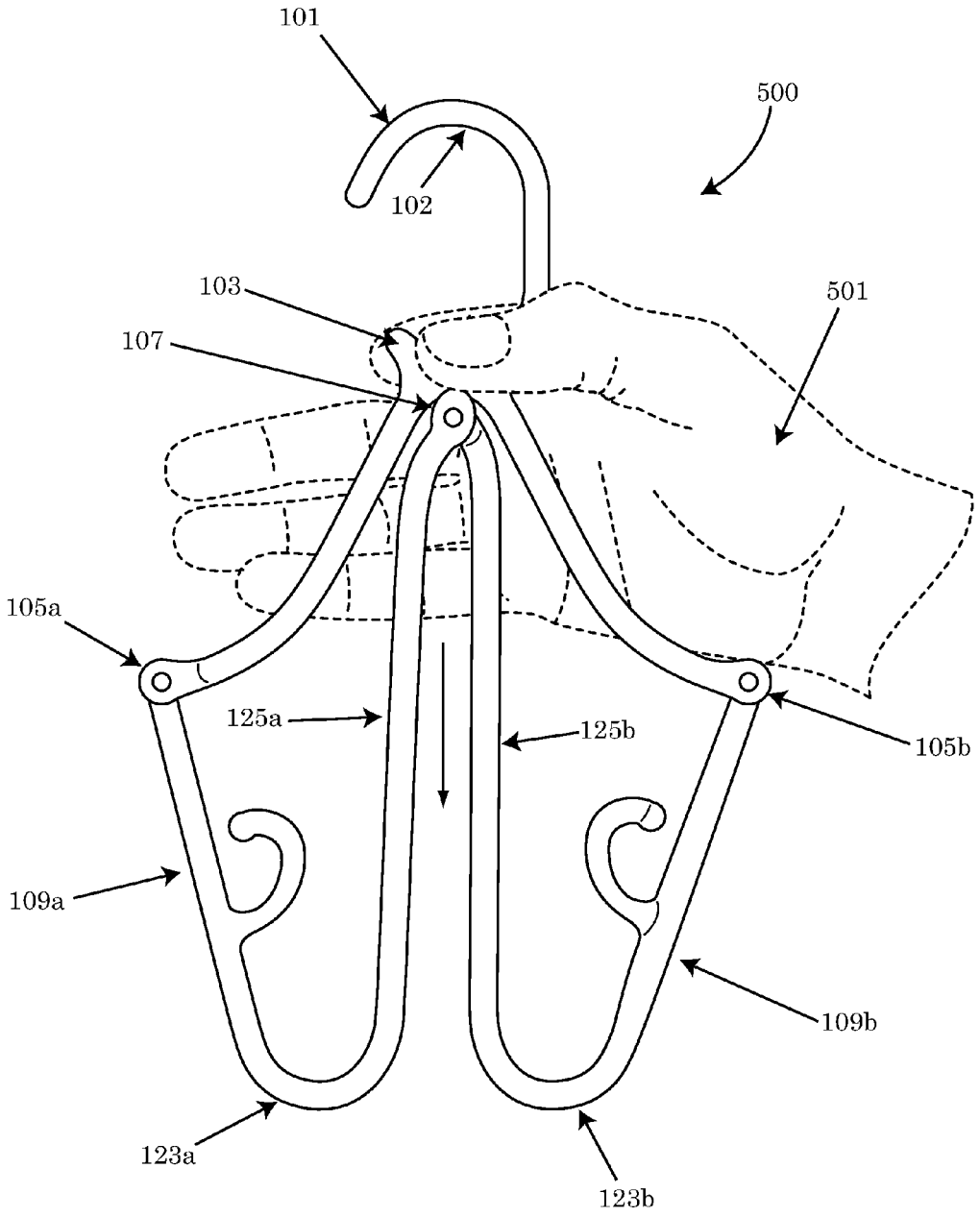
FIG. 5 depicts an embodiment of a method for manipulating a collapsible hanger apparatus.

Some embodiments of the collapsible hanger apparatus 100, 200 may be adjusted, configured or manipulated by users with an appendage such as the user's hand, a prosthetic limb, or a tool designed to extend a person's reach or mimic the functionality of a human hand. Embodiments of a method for operating the collapsible hanger using a single appendage may include the steps of providing a collapsible hanger having one or more of the features described above having a folded configuration 200 or an unfolded configuration 100. In the Exemplary embodiment, the provided collapsible hanger may include such components as a tongue 115 attached to a central body 110, a first shoulder 109*a* pivotally attached to the central body, a second shoulder pivotally attached to the central body 110 and a crossbar hinge 107 operably linking the first shoulder and second shoulder together. Embodiments of methods for operating the collapsible hanger may further include the steps of applying a first force 501 to the crossbar hinge 107. The force 501 may be instituted by the user and one or more of the user's appendages. For example, in the exemplary embodiment depicted in FIG. 5, the force 501 is demonstrated as a hand or prosthetic hand unfolding the collapsible hanger by making contact with the crossbar hinge 107 at an interface between the tongue 115 and the groove of the crossbar hinge. As depicted by the arrow, the force 501 of the appendage may manipulate the crossbar hinge away from the default position demonstrated in the figure.

In some embodiments of the method described above, the force 501, such as the force generated by the appendage, may make contact with the crossbar hinge 107 and manipulate it by grasping it at the interface of the connection between the male connector 132 and female receptacle 130. In alternative embodiments, the appendage may make contact with and guide the appendage along the tongue 115 which may have a decreasing thickness as described above. As the appendage moves in a direction along the tongue 115, toward the crossbar hinge, the appendage may make contact at one or more points along the walls of the female receptacle 130. Instead of grasping the crossbar 107, contact by the appendage may be made at the top surface 345 of the female receptacle 130 facing the direction of the tongue 115, in a manner sufficient to drive the crossbar hinge 107 toward the direction depicted by the arrow, thus initiating the rotation of the crossbar hinge, and hinges 105*a*. 105*b*, directing the folded configuration 200 into an unfolded configuration 100.

Embodiments of the method for operating a collapsible hanger using a single appendage may further comprise the step of positioning the hinge in a direction opposite the tongue 115. The energy used to position the hinge in the desired location may be derived from or provided by the first force 501 described above. The force 501 may be applied to position the crossbar hinge until the collapsible hanger apparatus enters the unfolded configuration. The unfolded configuration may be achieved and thus the force may be removed, when the position of the crossbar hinge reaches the default position of the collapsible hanger in the unfolded configuration, depicted in FIG. 1 and/or the force 501 positions the crossbar hinge 501 into a position that is at, or beyond, the transformational point, in a bimodal embodiment.

In some embodiments, the method for operating the collapsible hanger apparatus may include the steps of configuring the apparatus in the folded configuration to receive one or more pieces of clothing or garments. The step of adding clothing to the collapsible hanging apparatus may include placing the first shoulder 109*a* and the second shoulder 109*b* in the folded configuration. From the folded configuration 200, clothing or garments may be inserted over the collapsible hanging apparatus. Embodiments of the clothing may have an interior surface (e.g. the surface that touches the skin or undergarments when the clothing or garment is worn) that may make contact at one or more positions of the collapsible hanger in the folded configuration 200 or lie adjacent to one or more components of the collapsible hanger, including the central body and shoulders. In other embodiments, a user may choose to hang their clothing inside out, in such an embodiment, the interior surface making contact or adjacent to the shoulders or central body of the collapsible hanger may be the visible surface of the garment when the garment is worn properly that would normally be positioned as the exterior surface.

Embodiments of the method for operating a collapsible hanger apparatus may further include steps repositioning the unfolded configuration 100 of the collapsible hanger into folded configuration 200. Said method may include the steps of applying a second force to the crossbar hinge 107 of the collapsible hanger in the unfolded configuration. Similar to the first force 501 described above, the second force may also be generated by an appendage such as a hand or prosthetic of the user which may clasp, grasp or simply make contact with crossbar hinge. The force applied may be positioning the crossbar hinge toward the direction of the tongue 115 from the default position of the unfolded configuration 100. The second force positioning the crossbar hinge 107 may be applied until the collapsible hanger enters the folded confirmation 200. The folded confirmation may be achieved in some embodiments when the crossbar hinge reaches the default position of the crossbar hinge in the folded configuration 200 or in other embodiments that are bimodal, the second force may be removed once the second force positions the crossbar hinge at or beyond the transformation point needed for the collapsible hanger to automatically continue the transition into the folded confirmation 200 without further assistance of the user.

In some embodiments, the method for operating the collapsible hanger may further include the step of positioning the crossbar hinge at the default position in the unfolded configuration in the direction of the tongue 115, such that the groove or gap formed by the crossbar hinge 107 is nestling the tongue 115 within the groove or gap when the crossbar hinge is moved to its final position, entering into the folded configuration 200.

In some embodiments of the method for operating the collapsible hanger may further include a step of biasing the retention member 103 or the suspension member against a support, such as a support rod, clothing rod, hook or other support described above. In some embodiments of the method for operating the collapsible hanger, the suspension member may lose contact with the support. For example, when the second force is positioning the crossbar hinge toward the direction of the tongue. In such an embodiment, the force may raise suspension member so that it may no longer be biasing against the support. To prevent the collapsible hanger from removing itself from the support, the step of biasing the collapsible hanger against the retention member 103 may prevent the collapsible hanger from being removed from the support when the force is applied. This may allow the user to perform the method with a single appendage, instead of having to use one appendage to stabilize the hanger and using a second appendage to manipulate the crossbar hinge 107.

The foregoing description of the embodiments of this disclosure has been presented for purposes of illustration and description. It is not intended to be exhaustive or to limit the disclosure to the precise form disclosed, and obviously, many modifications and variations are possible. Such modifications and variations that may be apparent to a person skilled in the art are intended to be included within the scope of the above described disclosure.

What is claimed is:

1. A collapsible hanger apparatus comprising:

a central body having a suspension member, a first lower extending portion, a second lower extending portion, and a tongue adjacent to the suspension member, the first extending portion and the second extending portion;

a first shoulder pivotally attached to the first lower extending portion of the central body at a first end of the first shoulder;

a second shoulder pivotally attached to the second lower extending portion of the central body at a first end of the second shoulder; and a crossbar hinge formed by pivotally connecting the first shoulder at a second end to the second shoulder at a second end, said first shoulder at the second end is a female receptacle having a first wall, a second wall, a port located on the first wall or second wall and a gap between the first wall and second wall, said gap having a distance greater than or equal to a thickness of the tongue at a first end of the tongue;

wherein the gap between the first wall and second wall of the female receptacle receives the second end of the second shoulder includes a male connector, the male connector having a protrusion, the male connector fitting entirely between the gap of the first wall and second wall, and the protrusion of the male connector fits into the port located on the first wall or the second wall of the female receptacle; and the receipt of the male connector by the female receptacle creates a U-shaped groove formed by a combination of the first wall, second wall and an exterior surface of the male connector combined together, wherein the U-shaped groove is configured to receive and mate with the first end of the tongue of the central body, wherein the tongue tapers in thickness between the first end and a second end of the tongue, the first end of the tongue having a thickness less than a width of the U-shaped groove, and the second end having a thickness greater than the first end of the tongue.

2. The apparatus of claim 1 further comprising at least one accessory hook.

3. The apparatus of claim 1, wherein at least one portion of the first shoulder and at least one portion of the second shoulder tapers toward the crossbar hinge at a downward angle, adjacent to the crossbar hinge.

4. The apparatus of claim 1, wherein the crossbar hinge is an ovular shape.

5. The apparatus of claim 1, wherein the crossbar hinge has a thickness greater than the thickness of the central body.

6. The apparatus of claim 1, further comprising a retention member adjacent to the suspension member and the tongue.

7. The apparatus of claim 1, wherein the apparatus is bimodal.

8. The apparatus of claim 7, wherein the apparatus further includes a transformational point, wherein the apparatus automatically changes configuration from a folded or an unfolded configuration without further manipulation by a user.

9. A method for operating a collapsible hanger apparatus using a single appendage comprising the steps of:

providing a collapsible hanger apparatus having a folded configuration, said collapsible hanger apparatus having a tongue attached to a central body, a first shoulder pivotally attached to the central body, a second shoulder pivotally attached to the central body and a crossbar hinge operably linking the first shoulder and the second shoulder together, said crossbar hinge including a female receptacle having a first wall, a second wall, a port located on the first wall or second wall and a gap between the first wall and second wall receiving a male connector having a protrusion, the male connector fitting entirely between the gap formed by the first wall and second wall, and the protrusion of the male connector fitting into the port of the female receptacle, wherein the step of receiving the male connector by the female receptacle creates a U-shaped groove formed by a combination of the first wall, second wall and exterior surface of the male connector;

fitting the tongue between the U-shaped groove of the crossbar hinge in the folded configuration, wherein the tongue contacts the exterior surface of the male connector within the U-shaped groove;

applying a first force to the crossbar hinge of the collapsible hanger apparatus with a single appendage of a user of the collapsible hanger apparatus; and positioning the crossbar hinge toward a direction opposite of the tongue using said first force, said force separating the tongue from the U-shaped groove of the crossbar hinge, applying the first force until the collapsible hanger apparatus enters an unfolded configuration.

10. The method of claim 9, further comprising the steps of:

placing the first shoulder and second shoulder of the collapsible hanger apparatus in the folded configuration adjacent to at least one interior surface of one or more pieces of clothing.

11. The method of claim 9, further comprising the steps of:

applying a second force to the crossbar hinge of the collapsible hanger apparatus, in the unfolded configuration; and positioning the crossbar hinge toward the direction of the tongue using said second force, until the collapsible hanger enters the folded configuration, wherein the tongue is repositioned between the U-shaped groove of the crossbar hinge formed by the first wall, and second wall of the female receptacle and the exterior surface of the male connector.

12. The method of claim 11 wherein the first force is provided by the single appendage of the user contacting the crossbar hinge at a top surface of the crossbar hinge and moving the single appendage toward the direction opposite of the tongue.

13. The method of claim 11, wherein the second force is produced by the single appendage of the user contacting the crossbar hinge in the folded configuration and moving the single hand toward the direction of the tongue.

14. The method of claim 11, further comprising the step of re-contacting the exterior surface of the male connector in the U-shaped groove formed by the crossbar hinge in the folded configuration, with the tongue attached to the central body.

15. The method of claim 9, wherein the collapsible hanger apparatus further includes a suspension member and a retention member.

16. The method of claim 15 further comprising the step of biasing the retention member against a support rod during the step of positioning the crossbar hinge toward the direction of the tongue using the second force.

17. A collapsible hanger apparatus having a folded configuration and an unfolded configuration comprising:

a central body having a suspension member and a tongue;

a first hinge pivotally attached to the central body and a first end of a first arm;

a second hinge pivotally attached to the central body and a first end of a second arm;

a crossbar hinge pivotally attached to a second end of the first arm and a second end of the second arm, wherein the second end of the second arm is a female receptacle with a first wall, a second wall, a port located on the first wall or second wall and a gap between the first wall and second wall, said gap having a distance sized to receive the second end of the first arm which includes a male connector, a protrusion on the male connector and not a female connector, wherein the first end of the first arm fits entirely between the gap and the protrusion inserts through the port, said crossbar hinge having a default position in the folded configuration whereby the tongue of the central body is contacting an exterior surface of the male connector of the crossbar hinge between the first wall and second wall and a default position in the unfolded configuration; and a transformational point located at a position between the crossbar hinge's default position in the folded configuration and the crossbar hinge's default position in the unfolded configuration, wherein said transformational point is located at a position that that is less than a total distance between the crossbar hinge's default position in the folded configuration and the crossbar hinge's default position in the unfolded configuration, whereupon separating the exterior surface of the male connector of the crossbar hinge from the contact with the tongue to the transformational point, automatically unfolds the collapsible hanger into the unfolded configuration.

* * * * *